US007185773B2

(12) United States Patent
Fetzer et al.

(10) Patent No.: US 7,185,773 B2
(45) Date of Patent: Mar. 6, 2007

(54) APPARATUS AND METHOD FOR STORING AND SHIPPING PRODUCTS

(75) Inventors: William H. Fetzer, Shelby, OH (US); Aaron John Waines, Shelby, OH (US); Dennis E. Cleland, New Washington, OH (US)

(73) Assignee: FMC of Plymouth, Ohio, Inc., Plymouth, OH (US)

( * ) Notice: Subject to any disclaimer, the term of this patent is extended or adjusted under 35 U.S.C. 154(b) by 0 days.

(21) Appl. No.: 10/906,593

(22) Filed: Feb. 25, 2005

(65) Prior Publication Data

US 2005/0184208 A1 Aug. 25, 2005

Related U.S. Application Data

(60) Provisional application No. 60/548,070, filed on Feb. 25, 2004.

(51) Int. Cl.
*A47B 47/00* (2006.01)

(52) U.S. Cl. ..... 211/195; 211/4

(58) Field of Classification Search ..... 211/195, 211/169, 4, 168; 269/153, 154, 156, 228, 269/239; 248/310, 637, 670, 188.2, 680, 248/183.4, 681, 500
See application file for complete search history.

(56) References Cited

U.S. PATENT DOCUMENTS 2,638,805 A * 5/1953 Bigelow ..... 269/3
3,942,783 A * 3/1976 Neef et al. ..... 270/30.05
4,241,906 A * 12/1980 Cole ..... 269/43
4,438,668 A * 3/1984 Solomon ..... 81/352
4,743,003 A * 5/1988 Dietlein ..... 269/43
5,185,987 A * 2/1993 Turvey et al. ..... 53/429
5,330,167 A * 7/1994 Plumb ..... 269/43
5,469,765 A * 11/1995 Franklin ..... 81/324
6,893,012 B2 * 5/2005 Wong ..... 269/249

* cited by examiner

*Primary Examiner*—Jennifer E. Novosad
(74) *Attorney, Agent, or Firm*—Hahn, Loeser & Parks, LLP; W. Edward Crooks

(57) ABSTRACT

A product storage apparatus or rack comprises a base having a product placement portion capable of receiving a product; means for clamping the product to the apparatus when the product is positioned on the apparatus; and, a linkage assembly that operates the clamping means, the linkage assembly optionally including a self-locking mechanism that locks the clamping means in a closed position, such that when the clamping means is in the closed position, force applied directly to the clamping means will not open the clamping means. A foot pedal may operate the linkage assembly. In one embodiment, the self-locking mechanism is an over-center mechanism. One or more product storage apparatuses can be attached to, or incorporated into, a shipping rack. In the shipping rack, the linkage assembly of one product storage apparatus may control an adjacent product storage apparatus.

20 Claims, 5 Drawing Sheets

APPARATUS AND METHOD FOR STORING AND SHIPPING PRODUCTS

This application claims the benefit of U.S. patent application Ser. No. 60/548,070, filed Feb. 25, 2004, which is hereby incorporated herein by reference.

TECHNICAL FIELD

The present invention relates generally to a method and apparatus for storing and shipping products and the like. In particular it relates to a carrier for products, such as engines, transmissions, drive shafts, small vehicles, all-terrain vehicles, jet skis, etc., that provides a self-locking, ergonomic, foot-operated clamping mechanism that enables the operator to secure and unsecure products therein without bending, allowing the carrier to be easily loaded and unloaded.

BACKGROUND OF THE INVENTION

This invention relates to a storage and shipment rack that self-centers a product therein and secures the same with a self-locking clamp mechanism. Prior art racks require the operator to bend over and, by hand, physically secure and unsecure the product via wires, clamping locks, sliding lock bars, etc. Racks of this type are very time consuming, as they utilize an ergonomically difficult clamping mechanism. The operator may also have to load and unload the product by hand. Also, there is a need for a self-locking clamping mechanism, that would generally prevent forces generated during shipment from releasing the retained product. The present invention at least provides a novel solution to these problems.

SUMMARY OF THE INVENTION

A product storage apparatus, or pod, comprises a base having a product placement portion capable of receiving a product; means for clamping the product to the apparatus when the product is positioned on the apparatus; and, a linkage assembly that operates the clamping means, the linkage assembly optionally including a self-locking mechanism that locks the clamping means in a closed position, such that when the clamping means is in the closed position, force applied directly to the clamping means will not open the clamping means. In one embodiment, the self-locking mechanism is an over-center mechanism.

The linkage assembly may comprise a pivot; a cross bar attached to the pivot, the cross bar having a first end and a second end; a first linkage arm extending over the pivot, the first linkage arm having one end rotatably attached to the first end of the cross bar, and the other end operably attached to the first clamp; a second linkage arm extending under the pivot, the second linkage arm having one end rotatably attached to the second end of the cross bar, the other end operably attached to the second clamp.

An example an optional self-locking configuration provides that, when the clamps are closed, the pivot is located no lower than a line extending between the first linkage arm attachment to the cross bar and the first linkage arm attachment to the first clamp, and the pivot is located no higher than a line extending between the second linkage arm attachment to the cross bar and the second linkage arm attachment to the other clamp.

In another aspect of the invention, a shipping rack may comprise a frame; a hub pod having a first product placement portion and a first pair of clamps for retaining a first product when the first product is placed on the hub pod; a non-hub pod having a second product placement portion and a second pair of clamps for retaining a second product placed on the non-hub pod; and means for simultaneously operating both the first pair of clamps and the second pair of clamps. The shipping rack may optionally include a self-locking or over-center assembly that operates the clamps.

DETAILED DESCRIPTION

Figure 1:
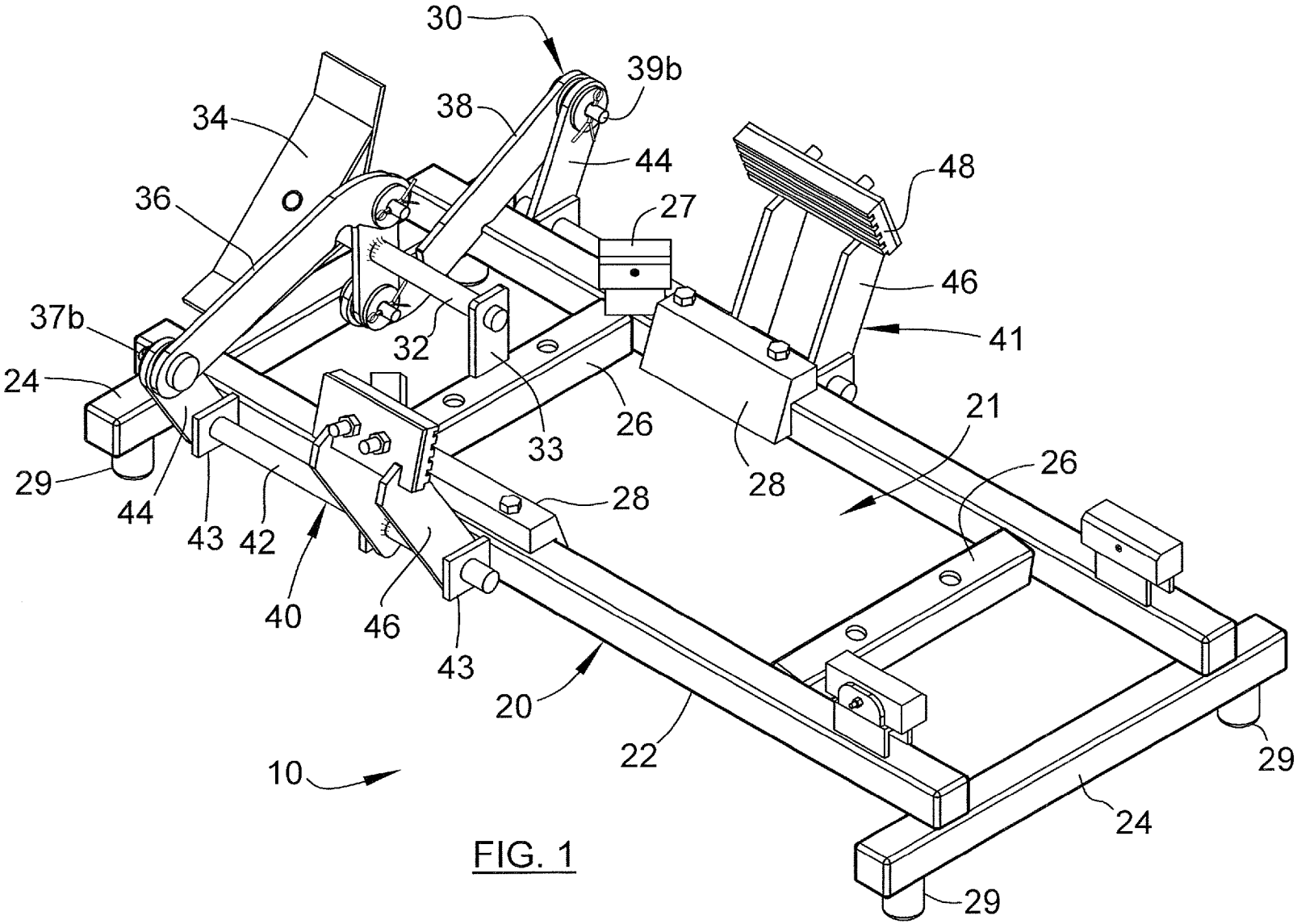
FIG. 1 is a perspective view of a product storage apparatus with the clamps open.
Figure 2:
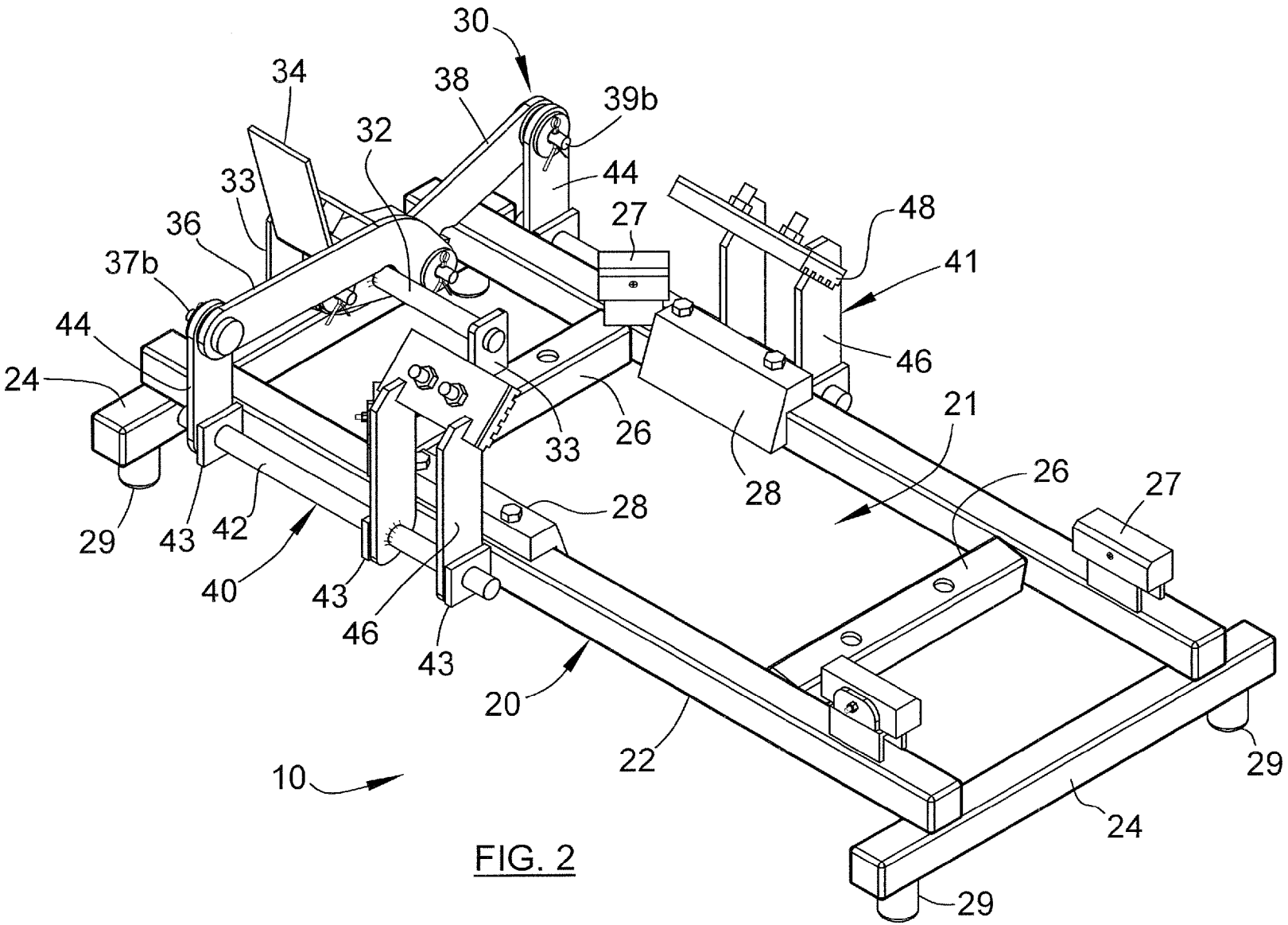
FIG. 2 is a perspective view of the product storage apparatus of FIG. 1, shown with the clamps closed.
Figure 3:
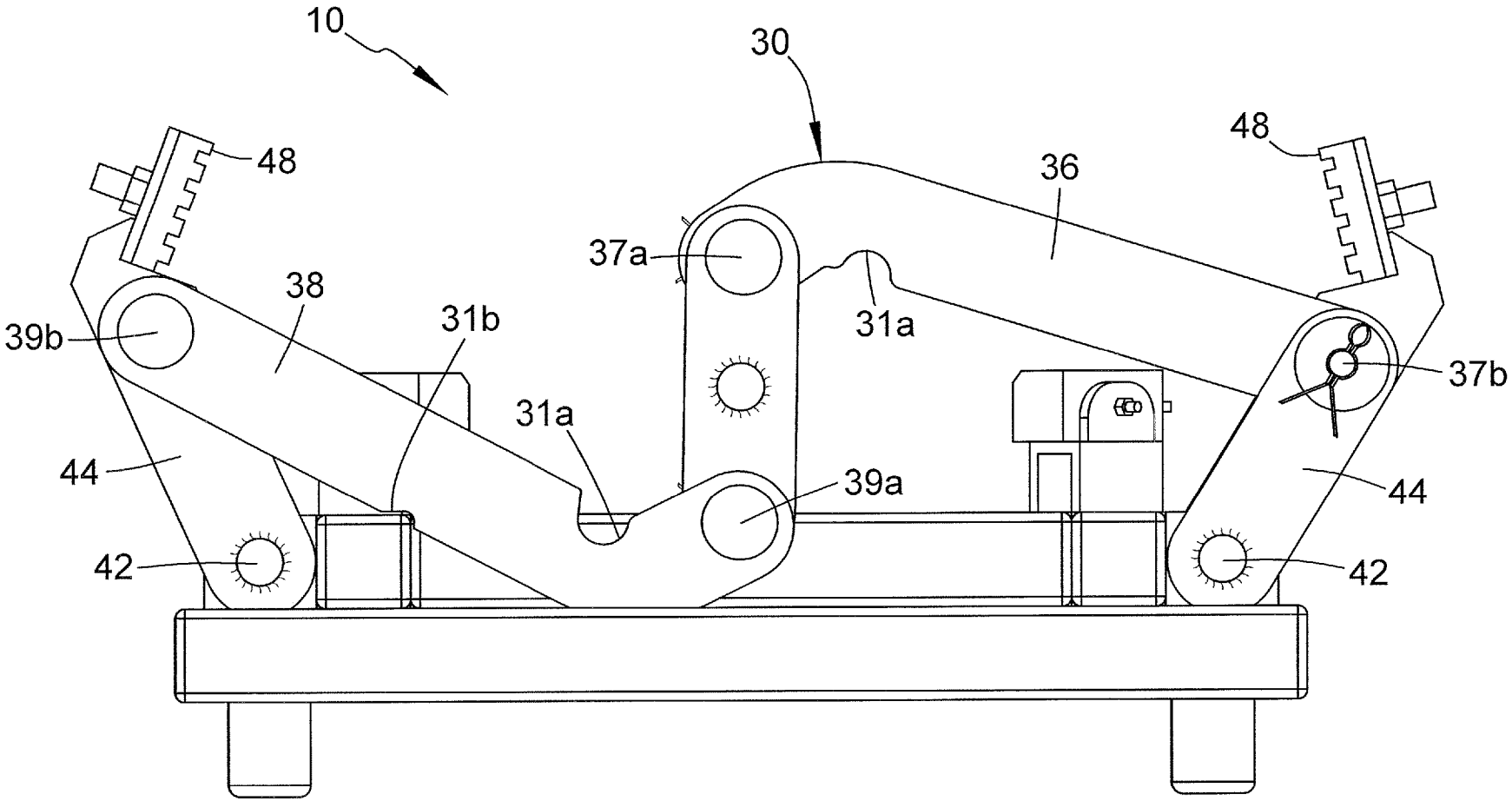
FIG. 3 is an end elevational view of FIG. 1.
Figure 4:
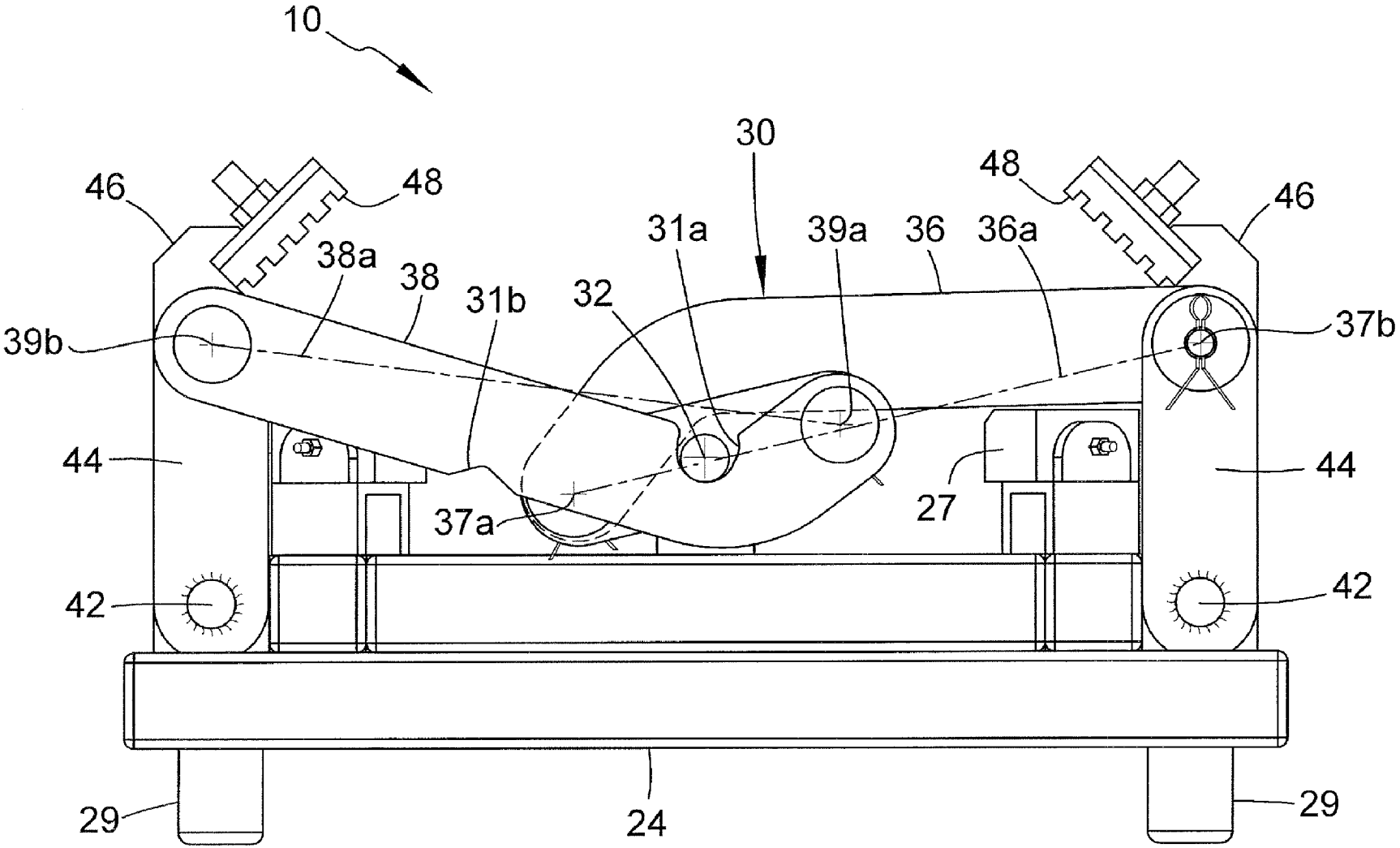
FIG. 4 is an end elevational view of FIG. 2.

Referring to FIGS. 1–4, each storing or shipping unit 10 (hereinafter referred to as "pod") comprises a base 20, a self-locking (or over-center) clamping mechanism 30, and clamps 40, 41. Pod 10 utilizes clamping mechanism 30 to secure a product placed within pod 10 via clamps 40, 41. Mechanism 30 is self-locking, which means that when the mechanism 30 is fully engaged to secure the product, clamps 40, 41 cannot be released by applying forces at the clamp/product interface. This prevents any vibrations or other forces operating upon clamps 40, 41, which may be generated during shipment or transportation thereof, from disengaging clamps 40, 41. The only way the clamps 40, 41 can be released, outside a failure or defect, is by intentionally operating mechanism 30.

Base 20 comprises longitudinal members 22 and transverse members 24 and provides, as a portion thereof, a product storage area 21. Members 22, 24 attach to each other to form a structurally sound base 20 capable of supporting a desired product. Cross members 26 may also be required to provide a structurally sound base 20, or to provide a surface for placing the product to be stored thereon. Members 22, 24, 26 may be formed of any suitable metallic or polymeric material. Product cushions 27 and self-centering guides 28 may be located within the product storage area, removably or fixedly attaching to base 20, such as upon members 22, 24, 26. Cushions 27 and guides 28 may be constructed of any commercially available material, including any rubber, polymeric, or metallic material. The design of cushions 27 and guides 28 may be specific to each product to be stored therein, wherein each may include downward sloping surfaces, angling inward toward the placement area, or any other configuration specific to the size and shape of the specific product. Further, spacers 29, made of any commercially available material, may be used to place cushions 27 and/or guides 28 in a vertical position that facilitates proper product placement within pod 10. Finally, feet 29 may attach to the underside of base 20, whereto wheels may further attach and facilitate translation of pod 10. A handle or hitch may attach to base 20 as means of attaching pod 10 to a translational source or to a second pod 10.

Self-locking clamp mechanism 30 operably mounts to base 20 outside the product placement area 21. In the present exemplary embodiment, the mechanism mounts alongside placement area 21; however, it is contemplated that mechanism may mount below or above or within placement area 21. Generally, mechanism 30 may include a central pivot 32; a lever 34, a cross-bar 35; an over-pivot linkage 36; an under-pivot linkage 38; and clamps 40. Central pivot 32 rotatably attaches to base 20, such as by ear tabs 33, while lever 34 and cross-bar 35 attach to pivot 32. Lever 34 provides a means for an operator to rotate pivot 32 and drive mechanism 30. It is contemplated that lever 34 may attach directly to cross-bar 35, thereby rotating cross-bar 35 about a fixed pivot 32 (as opposed to rotating pivot 32). It is contemplated that lever 34 may be secured in a position to prevent movement thereof, such as by a locking pin or padlock.

Over-pivot linkage 36 and under-pivot linkage 38 rotatably attach to opposite ends of cross-bar 35 and clamps 40, 41, generally using pins or the like. From its attachment to one end of cross-bar 35, at an over-pivot/cross-bar joint 37*a*, over-pivot linkage 36 travels over pivot 32 and attaches to one of clamp 40 at an over-pivot/clamp joint 37*b*. Under-pivot linkage 38 attaches to the opposite end of cross-bar 35 at under-pivot/cross-bar joint 39*a*, and travels below pivot 32 at ultimately attach to the opposite clamp 41 at under-pivot/clamp joint 39*b*. The shape of linkages 36, 38 and the location of their attachments are such that they prevent cross-bar 35 from rotating pivot 32 and subsequently opening or releasing the clamps 40, 41 when an opening force is applied to either linkage 36, 38 by clamps 40, 41, when clamps 40, 41 are closed. In other words, no moment arm exists between either of the linkages 36, 38 and pivot 32 that would allow the pivot 32 to rotate and open clamps 40, 41 by any force applied by the clamps 40, 41. This results in an over-center mechanism design that is self-locking.

The exemplary geometry for the over-pivot linkage 36 provides a pivot 32 that, when clamps 40, 41 are closed, is positioned no lower than a line 36*a*, defined by the central axes of joints 37*a*, 37*b*, the points where the over-pivot linkage 36 attaches to cross member 35 and clamp 40. The exemplary geometry for the under-pivot linkage 38 provides a pivot 32 that is positioned no higher than a line 38*a*, defined by the central axes of joints 39*a*, 39*b*, the points where the under-pivot linkage 36 attaches to cross member 35 and clamp 41. Notches 31*a* may exist upon the edge of both linkages 36, 38 adjacent to pivot 32, which allow pivot 32 to rest therein when the clamps 40, 41 are fully engaged (or closed) and provides a means of achieving the respective geometries detailed above. Finally, a stop 31*b* may exist that limits the rotation of pivot 32 when disengaging (or opening) the clamps 40, 41. Stop 31*b* may form an extension that protrudes from base 20 or mechanism 30 to interfere with the other, or it may form a notch within under-pivot linkage 38 that interferes with base 20.

Clamps 40, 41 may occur in pairs, whether a single pair or multiple pairs, with each pair having clamps 40, 41 located on opposing sides of product placement area 21. Additionally, it is contemplated that no pairs may exist, and instead having a single clamp operate to secure a product within product placement area 21 relative to a fixed surface. Clamps 40, 41 may be removable so to provide different clamp designs for different products. In the present embodiment, each clamp 40, 41 generally comprises a shaft 42, a linkage connector 44, a contact extension 46, and contact 48. It is contemplated that contact extension 46 may not exist based upon pod 10 requirements, the considerations including the product's shape and size and the need for pod 10 to be more compact. Shaft 42 may extend in a direction substantially perpendicular to linkages 36, 38 and rotatably attach to base 20, such as by way of ear tabs 43. Linkage connector 44 attaches to shaft 42, extending upward therefrom to rotatably attach to either linkage 36, 38, such as by pins or the like. Contact extension 46 attaches to shaft 42, extending therefrom to allow contact 48 to properly reach the product when clamps 40, 41 are closed. It is contemplated that extension 46 may be removable, so to provide different designs thereof for different stored products. Contact 48 is the member that touches the stored product, thereby completing securement thereof. Contact 48 may be made form any commercially available metallic, polymeric, or rubber material. It is contemplated that the stored product may require each shaft 42 to have more than one contact 48 and/or extension 46. Ultimately, the design of clamps 40, 41 is unique to the to-be-stored product. The only concern of this invention is that clamps 40, 41 close upon and release from a product. Therefore, the location, size, shape, and material of shaft 42, linkage connector 44, contact extension 46, and contact 48 may vary with each product to be stored within pod 10.

When the operator rotates lever 34 to engage, close, or lock clamps 40, 41 upon a stored product, pivot 32 begins to turn in the same direction (for example, counter-clockwise) and rotate cross-bar 35. Consequently, over-pivot linkage 36 and under-pivot linkage 38 begin to rotate similarly and translate toward pivot 32, causing clamp 40 to rotate in a counter-clockwise direction and clamp 41 to rotate in a clockwise direction. Pivot 32 continues to rotate at least pivot 32 rests on or above the line 36*a* formed between joint 37*a* and joint 37*b*, and on or below the line 38*a* formed between joint 39*a* and joint 39*b*. Ultimately, linkages 36, 38, and any existing notches 31, collapse upon pivot 32 as clamps 40, 41 close upon the product. Due to the location of joints 37*a*, 39*a* in relation to pivot 32, no moment arm exists between joint 37*a* or joint 39*a* and pivot 32 that would allow an opening force applied to cross-bar 35 from either linkage 36, 38 to rotate pivot 32 in a clockwise direction. When mechanism 30 is closed, the only means of opening mechanism 30 is to rotate pivot 32, either directly or by way of lever 34. Rotating lever 34 clockwise (consistent with this example) to open mechanism 30 and disengage or unlock clamps 40, 41 rotates pivot 32 in the same direction. As pivot 32 continues to rotate, linkages 36, 38 rotate similarly and translate to rotate clamps 40, 41 away from each other, thereby allowing the part to be removed from pod 10. Rotational movement of the mechanism 30 terminates when the stop, herein embodied as a notch in the lower portion of under-pivot linkage 38, abuts base 20.

Figure 5:
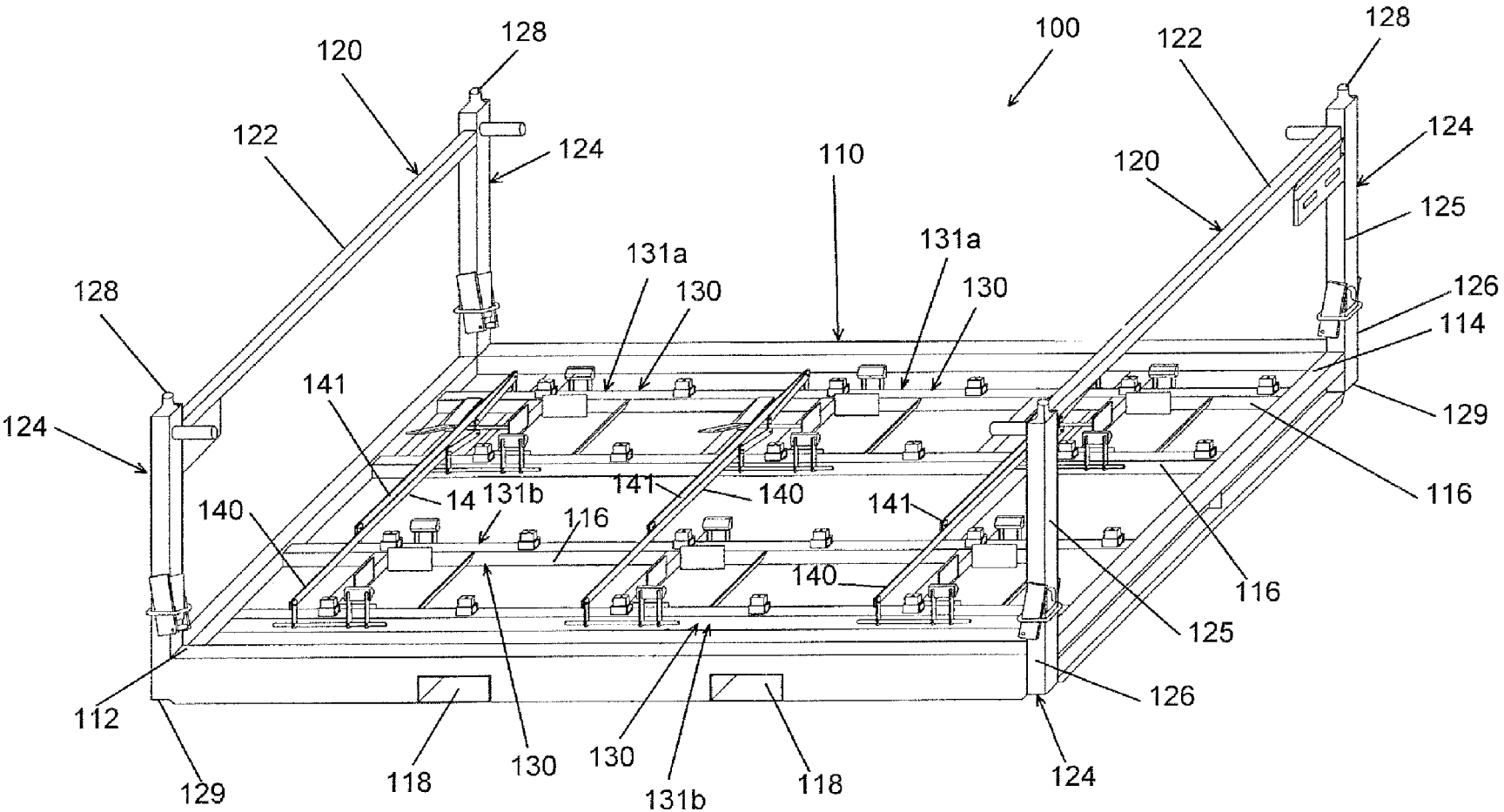
FIG. 5 is a perspective view of a shipping rack with multiple product storage apparatuses therein.

Referring to FIG. 5, a storage or shipping rack 100 incorporates at least one pod or product storage apparatus 10, 130 to form a rack for shipping products. Rack 100 generally comprises a frame 110, at least one pod 10, 130, and, if including adjacent pods 10, 130, connecting linkages 140, 141. Rack 100 may also include a post unit 120 for stacking other racks atop thereof. Frame 110 generally includes longitudinal members 112 and transverse members 114, which are joined to form a structure capable of storing and transporting the products to-be-stored. At least one cross member 116 may be used to provide such a structure and to facilitate the inclusion of pods 10, 130. Forklift members 118, which may be included to better allow a forklift to handle rack 100, may also function as cross members 116. It is contemplated that other lift or securement means, such as hoist rings, hook holes, etc., may exist on frame 110. Finally, post assembly 120 may attach to or be incorporated into frame 110. Post assembly 120 may comprise cross rails 122 and posts 124. Cross rails 122 and posts 124 may be removable and/or collapsible to better facilitate return and storage of empty racks 100. Posts 124 may have a top removable or collapsible portion 125 and a stationary portion 126. Finally, posts 124 may include a top end 128 and a bottom end 129, wherein top end 128 mates with bottom end 129 to improve stack-ability or securement thereof. All structural elements recited above may comprise metallic or polymeric tubes or channels.

Rack 100 may incorporate at least one pod 10 discussed above, also referred to as a hub pod or master product storage apparatus, and/or at least one pod 130, also referred to as a non-hub pod or slave product storage apparatus, which is a modification of pod 10. Pod 10 at least exists as discussed above, while pod 130 may substitute any combination of members 112, 114, 116, 118 for base 20, or at least one connecting linkage 140, 141 for at least a portion of mechanism 30. In the present embodiment, three pairs of adjacent pods 10, 130 (three rows of two adjacent pods 10, 130) exist within rack 100. It is important to note that quantity of pods included within rack 100 depend upon the size constraints of the rack 100 and the size of the products to be shipped or stored. For example, there may be one row of three adjacent pods 130, or there may be ten rows of ten adjacent pods 130. Pods 130 or rows thereof may be spaced apart so to permit portions any stored product to project beyond the storing pod or row. Pods 10, 130 secure to frame 110 in any commercially known manner, or combination thereof, including welds, bolts, and the like.

Pods 10, 130 may operate independently of each other, or at least a portion of pods 10, 130 operate together. In the present embodiment, pods 10, 130 operate together within each row, wherein one pod 10, 130 therein, called the hub pod 131*a*, retains mechanism 30 and concurrently operates the remaining pods 10, 130 by way of connecting linkages 140, 141. Connecting linkage 140 rotatably attaches to clamp 40 of hub pod 131*a* and to clamp 40 of an adjacent non-hub pod. Similarly, connecting linkage 141 rotatably attaches to clamp 41 of hub pod 131*a* and to clamp 41 of an adjacent non-hub pod. The non-hub pod is now considered a linked pod 131*b* because its clamps are now operated by hub pod 131*a* through linkages 140, 141. A series of linked pods 131*b* may exist provided each includes linkages 140, 141 that are connected to another linked pod 131*b*. In this embodiment, all pods 131*a*, 131*b* are oriented in the same direction. Consequently, mechanism 30 of hub pod 131*a* operates to open and close all clamps 40, 41 within the series concurrently. It is contemplated that a single mechanism 30 may operate all pods 10, 130 within rack 100 regardless of row affiliation, for example, by extending pivot 32 to adjacent pods 10, 130 in adjacent rows or by providing linkages between clamps 40, 41 of adjacent pods 10, 130 in adjacent rows. It is also contemplated that the orientation of rows, pods 10, 130 within each row, or the placement area 21 within a pod 10, 130 may vary between adjacent rows or pods 10, 130, so to allow certain sides of pods 10, 130 to be exposed to the exterior of the rack 100. This allows an operator to place the sides of pods 10, 130 or products, that, for example, are more susceptible to damage, away from the rack perimeter and within the rack 100, thereby reducing any risk of damage thereto. Consequently, more than one hub pod 131*a* may exist within each row, if any hub pod 131*a* exists at all. In the end, the design of rack 100 is application-specific, which, by way of example, may be based upon the size of the product to be stored, the manner of shipment, and the manner used to load or unload rack 100.

Although the present invention has been described above in detail, the same is by way of illustration and example only and is not to be taken as a limitation on the present invention.

What is claimed is:

1. A product storage apparatus, comprising:

a base having a product placement portion capable of receiving a product;

means for clamping the product to the product placement portion when the product is positioned on the product placement portion, the clamping means being rotatable from a first open position to a second closed position; and, a self-locking linkage assembly that operates the clamping means and locks the clamping means in the closed position, such that when the clamping means is in the closed position, force applied directly to the clamping means will not open the clamping means.

2. The product storage apparatus as recited in claim 1, wherein clamping means comprises a first clamp and a second clamp, and the self-locking linkage assembly comprises a pivot; a cross bar attached to the pivot; a first linkage arm attached to the cross bar and to the first clamp; and a second linkage arm attached to the cross bar and to the second clamp.

3. The product storage apparatus as recited in claim 1, wherein the clamping means comprises a first clamp and a second clamp, and the linkage assembly comprises:

a pivot;

a cross bar attached to the pivot, the cross bar having a first end and a second end;

a first linkage arm extending over the pivot, the first linkage arm having one end rotatably attached to the first end of the cross bar, and the other end operably attached to the first clamp;

a second linkage arm extending under the pivot, the second linkage arm having one end rotatably attached to the second end of the cross bar, the other end operably attached to the second clamp.

4. The product storage apparatus as recited in claim 3, wherein when the clamps are in the second position, the pivot is located no lower than a line extending between the first linkage arm attachment to the cross bar and the first linkage arm attachment to the first clamp, and the pivot is located no higher than a line extending between the second linkage arm attachment to the cross bar and the second linkage arm attachment to the other clamp.

5. The product storage apparatus as recited in claim 4, further comprising:

a lever operably attached to the pivot, the lever facilitating rotation of the pivot between a first and second position.

6. The product storage apparatus as recited in claim 5, wherein the lever is a foot pedal.

7. The product storage apparatus as recited in claim 3, wherein when the clamps are in the closed position, an opening force applied to the clamps does not produce a rotational moment arm at the pivot.

8. The product storage apparatus as recited in claim 3, wherein each of the first and second clamps include:

a shaft rotatably attached to the base;

an engagement portion operably attached to the shaft, the engagement portion being adapted to contact the product when the product is positioned on the product storage apparatus and the clamps are in a closed position; and a linkage connector that attaches the shaft to one of the linkage arms.

9. The product storage apparatus of claim 8, wherein the engagement portion includes a section that is removable to enable a user to adapt the product storage apparatus for different products.

10. The product storage apparatus of claim 8, wherein the engagement portion is at least partially polymeric.

11. The product storage apparatus of claim 1, wherein the product placement portion includes at least one guide that is adapted to self-align the product as the product is placed on the storage rack.

12. The product storage apparatus of claim 1, further comprising at least two feet attached to the base along a bottom portion thereof.

13. A shipping rack comprising:

a frame; and at least one product storage apparatus of claim 1 operably attached to the frame.

14. A shipping rack, comprising:

a frame; and at least one product storage apparatus of claim 1, the base of the at least one product storage apparatus being incorporated into the frame.

15. The shipping rack of claim 14, wherein the clamping means comprises a first pair of clamps.

16. A method of storing a product comprising the steps of:

placing a product on the product storage apparatus of claim 1; and operating the clamping means to secure the product to the apparatus.

17. A shipping rack, comprising:

a frame;

a master product storage apparatus, and, a slave product storage apparatus adjacent to the master product storage apparatus, wherein the master product storage apparatus comprises:

a first product placement portion capable of receiving a product;

a first clamp and a second clamp that are moveable between an open position and a closed position and are adapted to secure a product to the first product placement portion; and a self-locking linkage assembly that operates the first and second clamps, comprising a pivot; a cross bar attached to the pivot, the cross bar having a first end and a second end; a first linkage arm extending over the pivot, the first linkage arm having one end rotatably attached to the first end of the cross bar, and the other end operably attached to the first clamp; and a second linkage arm extending under the pivot, the second linkage arm having one end rotatably attached to the second end of the cross bar, the other end operably attached to the second clamp, and wherein the slave product storage apparatus comprises:

a second product placement portion capable of receiving a product;

a third clamp and a fourth clamp that are adapted to secure a product to the second product placement portion;

a third linkage arm having one end connected to the third clamp and the other end connected to the first clamp; and a fourth linkage arm having one end connected to the fourth clamp and the other end connected to the second clamp, wherein actuation of the linkage assembly of the master product storage apparatus also actuates the third and fourth clamps of the slave product storage apparatus via the third and fourth linkage arms.

18. The shipping rack as recited in claim 17, wherein the shipping rack includes a self-locking mechanism that locks the first and second clamps and the third and fourth clamps in closed positions, such that when the clamps are in the closed positions, force applied directly to the clamps will not open the clamps.

19. A first shipping rack according to claim 17, further comprising means for stacking a second shipping rack according to claim 17 on top of the first shipping rack.

20. A shipping rack comprising:

(a) a frame;

(b) a product storage apparatus having:

a base incorporated into the frame and having a product placement portion capable of receiving a product;

a first pair of clamps for securing the product to the product placement portion when the product is positioned on the product placement portion; and, a linkage assembly that operates the clamping means, the linkage assembly including a self-locking mechanism that locks the clamping means in a closed position, such that when the clamping means is in the closed position, force applied directly to the clamping means will not open the clamping means; and (c) a slave product storage apparatus having:

a second base incorporated into the frame and having a second product placement portion capable of receiving a second product;

a second pair of clamps for clamping the second product to the second product placement portion when the second product is positioned on the second product placement portion; and, a clamp transfer linkage connecting the first pair of clamps to the second pair of clamps; wherein, the linkage assembly of the product storage apparatus simultaneously operates both the product storage apparatus clamps and the slave product storage apparatus clamps.

* * * * *